US007989389B2

(12) United States Patent
Hada et al.

(10) Patent No.: US 7,989,389 B2
(45) Date of Patent: Aug. 2, 2011

(54) HEAT-SENSITIVE RECORDING MATERIAL

(75) Inventors: Kunihiko Hada, Shizuoka (JP); Yoshikazu Kaneko, Numazu (JP); Michiyo Fukushima, Tokyo (JP); Kazuyuki Uetake, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 812 days.

(21) Appl. No.: 12/046,841

(22) Filed: Mar. 12, 2008

(65) Prior Publication Data

US 2009/0176647 A1 Jul. 9, 2009

(30) Foreign Application Priority Data

Mar. 13, 2007 (JP) ..... 2007-064013

(51) Int. Cl.
*B41M 5/337* (2006.01)

(52) U.S. Cl. ..... 503/214; 503/216; 503/226

(58) Field of Classification Search ..... None
See application file for complete search history.

(56) References Cited

U.S. PATENT DOCUMENTS

| | | | |
|---|---|---|---|
| 5,409,881 | A | 4/1995 | Mori et al. |
| 5,536,697 | A | 7/1996 | Hada et al. |
| 5,646,088 | A | 7/1997 | Hada et al. |
| 5,703,006 | A | 12/1997 | Mori et al. |
| 6,710,015 | B2 | 3/2004 | Kaneko et al. |
| 6,846,619 | B2 | 1/2005 | Kaneko et al. |
| 6,890,698 | B2 | 5/2005 | Naruse et al. |
| 2006/0205593 | A1 | 9/2006 | Kadota et al. |

FOREIGN PATENT DOCUMENTS

| | | |
|---|---|---|
| JP | 59-159394 | 9/1984 |
| JP | 3-173680 | 7/1991 |
| JP | 2515411 | 4/1996 |
| JP | 2000-6520 | 1/2000 |
| JP | 2003-266950 | 9/2003 |
| JP | 3812894 | 6/2006 |

*Primary Examiner* — Bruce H Hess

(74) *Attorney, Agent, or Firm* — Cooper & Dunham LLP

(57) ABSTRACT

The present invention provides a heat-sensitive recording material having a support, a heat-sensitive color-developing layer containing a leuco dye and a developer, and a protective layer, the heat-sensitive color-developing layer and the protective layer being formed on the support, wherein carboxylic-acid-modified polyvinyl alcohol with a weight average degree of polymerization of 100 to 400 and a modification degree of 0.2 mol % to 1.0 mol % is used as a dispersing agent for dispersing the leuco dye.

12 Claims, No Drawings

HEAT-SENSITIVE RECORDING MATERIAL

BACKGROUND OF THE INVENTION

1. Field of the Invention

The present invention relates to a heat-sensitive recording material having an excellent dispersion quality for leuco dyes to be used for heat-sensitive color-developing layers and showing an excellent whiteness degree in ground color.

2. Description of the Related Art

Various recording materials have been studied, developed and put to practical use in the field of information recording in response to the diversification of information and expansion of needs in recent years. Particularly, heat-sensitive recording materials have advantages such as: (a) simple image recording is possible only by a heating process; and (b) required device mechanisms are simple and easily downsized, as well as recording materials are easily handled and are available at low cost. Thus, they have been used in a large number of different technological fields including information processing (outputs of desktop calculators, computers and so on), recorders for medical instruments, low and high-speed facsimile machines, automatic ticket vending machines (railway tickets, entry tickets, etc.), heat-sensitive copying machines and labels to be used in POS systems.

While thermal printers are normally employed to record various pieces of information on heat-sensitive recording materials, the operating speed of thermal printers has been improved in response to the increasing demand for heat-sensitive recording materials. Thermal printers have a thermal head in the inside and image information is formed on a heat-sensitive recording material as the thermal head is brought into contact with and apply thermal energy to the surface of the heat-sensitive recording material. Therefore, it is important that the heat-sensitive recording material shows a high coloring sensitivity in order to realize high-speed printing.

Various techniques have been proposed to improve the coloring sensitivity. According to one of such techniques, a leuco dye that is a coloring material is crushed into a small particle size so that it may be molten and color-developed with ease when heated by a thermal head.

A leuco dye is normally contained in a heat-sensitive color-developing layer of a heat-sensitive recording material. However, in order to uniformly disperse the leuco dye in the coating solution to form the heat-sensitive color-developing layer, the leuco dye that is an originally powdery solid has to be crushed into fine particles and put into a state of liquid dispersion by means of a dispersing mill. The coloring sensitivity of leuco dye can be improved by applying a large shearing force or prolonging the dispersing time in order to dimensionally minimize leuco dye particles in the process of dispersing the leuco dye.

There have been proposals of adding water soluble resin such as polyvinyl alcohol when dispersing leuco dyes for the purpose of raising the dispersion efficiency or stably holding leuco dye particles in a liquid.

For instance, Japanese Patent Application Laid-Open (JP-A) No. 59-159394 describes that a heat-sensitive recording material that is free from the problem of sticking and adhesion of sediments and operates well with thermal heads can be obtained by using a fluoran compound having a substituted or an unsubstituted amino group at least at 3- and 7-positions and carboxylic group modified polyvinyl alcohol as a dispersing agent for the fluoran compound.

Japanese Patent Application Laid-Open (JP-A) No. 03-173680 describes that a heat-sensitive recording material showing an excellent coloring sensitivity can be obtained by using polyvinyl alcohol and isobutylene-maleic anhydride ammonium as leuco dye a dispersing agent and dispersing the leuco dye down to a particle diameter of 0.7 μm.

Japanese Patent Application Laid-Open (JP-A) No. 2000-6520 describes that a heat-sensitive recording material showing an excellent coloring sensitivity and a high anti-moisture conservation property for colored images can be obtained by using carboxy-modified polyvinyl alcohol or sulfonic acid-modified polyvinyl alcohol along with an ionomer type resin as leuco dye a dispersing agent.

However, as the coloring sensitivity is improved, the texture whiteness degree falls remarkably as antinomy when dyes are micronized (down to an average particle diameter of 0.3 μm or less) by using any of the above-described techniques in an attempt to further improve the coloring sensitivity in order to meet the demand for a higher coloring sensitivity that has been increasing in recent years. The underlying mechanism of the antinomy is that, when a heat-sensitive solution (a mixture solution of a leuco dye dispersion and a developer dispersion) is prepared by using a highly micronized leuco dye, the contact area of the developer and the dispersion is increased to weaken the structure of the coloring material and reduce the texture whiteness degree of the heat-sensitive recording material.

As another known technique, Japanese Patent Application Laid-Open (JP-A) No. 2003-266950 describes that a heat-sensitive recording material that shows a high texture whiteness degree and provides an excellent stability for both the colored image and the texture can be obtained with little liquid fog (weak coloring due to contact of dye dispersion and developer dispersion) by dispersing a leuco dye by making it contain an anionic surfactant as a dispersing agent, reducing the average particle diameter of the leuco dye to between 0.10 μm and 0.30 μm and using polyvinyl alcohol, polyacrylsulfonic acid metal salt or partially saponified polyvinyl alcohol as polymer a dispersing agent. However, the above-described technique is accompanied by a number of drawbacks including that the texture whiteness degree is not sufficient, that bubbles in the leuco dye dispersion can hardly move out because the remarkably raised viscosity of the dispersion to consequently give rise to a defective application of the dispersion, that it can be difficult to feed the dispersion in the manufacturing process and that the stability of the dispersion falls with time (the particle size grows and the coloring sensitivity falls as time elapses).

BRIEF SUMMARY OF THE INVENTION

In view of the above-identified circumstances, it is therefore an object of the present invention to provide a heat-sensitive recording material that has a high texture whiteness degree by using a leuco dye dispersion whose viscosity does not rise nor whose stability does not fall with time if the average particle diameter is micronized to 0.3 μm or less in the dispersion process.

The inventors of the present invention made intensive efforts to achieve the above-noted object and, as a result, found that the above object can be achieved by using carboxylic-acid-modified polyvinyl alcohol with a weight average degree of polymerization between 100 and 400 and a modification degree of 0.2 mol % to 1.0 mol %.

More specifically, the above object is achieved by any of 1) through 12) listed below.

1) A heat-sensitive recording material having a support, a heat-sensitive color-developing layer containing a leuco dye and a developer, and a protective layer, the heat-sensitive color-developing layer and the protective layer being formed on the support, wherein carboxylic-acid-modified polyvinyl alcohol with a weight average degree of polymerization of 100 to 400 and a modification degree of 0.2 mol % to 1.0 mol % is used as a dispersing agent for dispersing the leuco dye.

2) The heat-sensitive recording material according to the item 1), wherein the content of the carboxylic-acid-modified polyvinyl alcohol is 0.1 parts by weight to 0.4 parts by weight relative to 1 part by weight of the leuco dye.

3) The heat-sensitive recording material according to the item 1), wherein the heat-sensitive color-developing layer contains calcium carbonate as a filler.

4) The heat-sensitive recording material according to the item 1), wherein the developer contains 4-hydroxy-4'allyloxydiphenylsulfone and a diphenyl sulfone derivative expressed by the following General Formula (1):

General Formula (1)

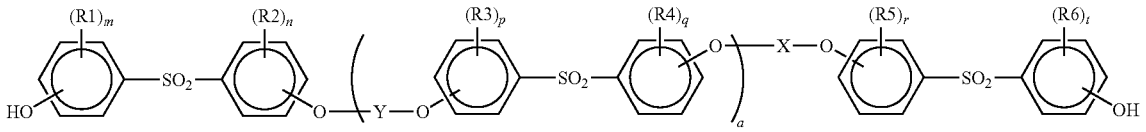

where X and Y may be the same to each other or different from each other, may be in the form of a straight chain or a branched chain, and each represents a hydrocarbon group having 1 to 12 carbon atoms that may have a saturated or an unsaturated ether bond, or a group expressed by any one of the following Formula (2) and Formula (3); "a" represents an integer of 0 to 10; each of R1 through R6 independently represents any one of a halogen atom, an alkyl group having 1 to 6 carbon atoms and an alkenyl group having 1 to 6 carbon atoms; and "m", "n", "p", "q", "r" and "t" each represents an integer of 0 to 4, when the integer is 2 or more, corresponding two or more of R1 through R6 may be different from each other, General Formula (2)

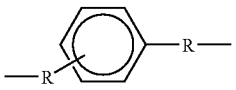

General Formula (3)

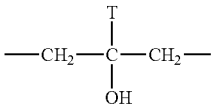

where R represents any one of a methylene group and an ethylene group, and T represents any one of a hydrogen atom and an alkyl group having 1 to 4 carbon atoms.

5) The heat-sensitive recording material according to the item 1), wherein the protective layer contains diacetone-modified polyvinyl alcohol and a hydrazide compound.

6) The heat-sensitive recording material according to the item 1), further having an intermediate layer containing at least hollow particles between the support and the heat-sensitive color-developing layer.

7) The heat-sensitive recording material according to the item 6), wherein the hollow particles have a void ratio of 80% or more.

8) The heat-sensitive recording material according to the item 6), wherein the intermediate layer contains carboxylic-acid-modified polyvinyl alcohol with a weight average degree of polymerization of 100 to 400 and a modification degree of 0.2 mo1% to 1.0 mol %.

9) The heat-sensitive recording material according to the item 8), wherein the carboxylic-acid-modified polyvinyl alcohol content of the intermediate layer is 0.1 parts by weight to 0.5 parts by weight relative to 1.0 part by weight of the hollow particles.

10) A heat-sensitive recording label having a heat-sensitive recording material, an adhesive layer, and a peeling paper base, the adhesive layer and the peeling paper base being formed on the rear surface of the heat-sensitive recording material in this order, wherein the heat-sensitive recording material has a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mmol % to 1.0 mol % is used as a dispersing agent for dispersing the leuco dye.

11) A heat-activation type heat-sensitive recording label eliminating the need for a peeling paper base, having a heat-sensitive recording material, and a heat-activation type adhesive layer formed on the rear surface of the heat-sensitive recording material, wherein the heat-sensitive recording material has a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mol % to 1.0 mol % is used as a dispersing agent for dispersing the leuco dye, and the heat-activation type adhesive layer is not adhesive at room temperature but is actively adhesive when heated.

12) A heat-sensitive recording type magnetic material having a heat-sensitive recording material, and a magnetic recording layer formed on the rear surface of the heat-sensitive recording material, wherein the heat-sensitive recording material has a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mol % to 1.0 mol % is used as a dispersing agent for dispersing the leuco dye.

DETAILED DESCRIPTION OF THE INVENTION

A heat-sensitive recording material according to the present invention has a support, a heat-sensitive color-developing layer containing a leuco dye and a developer and a protective layer, the heat-sensitive color-developing layer and the protective layer being formed on the support, and other layers in accordance with necessity.

—Heat-Sensitive Color-Developing Layer—

According to the present invention, carboxylic-acid-modified polyvinyl alcohol with a weight average degree of polymerization of 100 to 400 and a modification degree of 0.2 mol % to 1.0 mol % is used as a dispersing agent for dispersing the leuco dye.

Major physical properties that define the nature of polyvinyl alcohol include the degree of saponification, the degree of polymerization and the modification degree. Of these, the weight average degree of polymerization that is defined for the purpose of the present invention is the average number of repetitive units in a polymer molecule and the modification degree is the ratio (mol %) of the hydroxide groups substituted in order to provide polyvinyl alcohol with functional features such as solubility and reactivity.

For the purpose of the present invention, it is necessary that the weight average degree of polymerization of carboxylic-acid-modified polyvinyl alcohol be within a range of 100 to 400. When the weight average degree of polymerization is less than 100, the viscosity of the leuco dye dispersion does not rise, however, the dispersed particles are not stable and the whiteness degree in ground color is insufficient because the effect of protective colloid is not satisfactory relative to the leuco dye. In contrast, when the degree of polymerization is more than 400, the viscosity of the leuco dye dispersion rapidly rises in accordance with the process of dispersion and the micronization of particles. Meanwhile, the whiteness degree in ground color remarkably rises when the modification degree by carboxylic acid of the carboxylic-acid-modified polyvinyl alcohol is in a range of 0.2 mol % to 1.0 mol %.

It may be safe to assume that the dispersed particles of the leuco dye is electrochemically most stabilized and the protective colloid formed on the surfaces of the dispersed particles is in an appropriate condition for suppressing the reaction of the lueco dye with the developer in the dispersion when the weight average degree of polymerization and the degree of modification by carboxylic acid are within the above respective ranges.

The ratio to which the carboxylic-acid-modified polyvinyl alcohol is added to the leuco dye is within a range of 0.1 parts by weight to 0.4 parts by weight, preferably within a range of 0.2 parts by weight to 0.3 parts by weight relative to 1 part by weight of the leuco dye.

The leuco dye is not particularly limited, any leuco dye that is known in the technological field of heat-sensitive recording materials may be used alone or such leuco dyes may be used in combination of two or more.

Preferable examples of such leuco dyes include, triphenylmethane based, fluoran based, phenothiazine based, auramine based, spiropyran based and indolinophthalide based leuco dye compounds. Specific examples include 3,3-bis(p-dimethylaminophenyl)-phthalide, 3,3-bis(p-dimethyl aminophenyl)-6-dimethyl-aminophthalide (also called as crystal violet lactone), 3,3-bis(p-dimethylaminophenyl)-6-diethylaminophthalide, 3,3-bis(p-dimethylaminophenyl)-6-chlorphthalide, 3,3-bis(p-dibutylaminophenyl)phthalide, 3-cyclohexylamino-6-chlorfluoran, 3-dimethylamino-5,7-dimethylfluoran, 3-N-methyl-N-isobutyl-6-methyl-7-anilinofluoran, 3-N-ethyl-N-isoamyl-6-methyl-7-anilinofluoran, 3-diethylamino-7-chlorofluorane, 3-diethylamino-7-methylfluoran, 3-diethylamino-7,8-benzofluoran, 3-diethylamino-6-methyl-7-chlorfluoran, 3-(N-p-tolyl-N-ethylamino)-6-methyl-7-anilinofluoran, 3-pyrrolidino-6-methyl-7-anilinofluoran, 2-{N-(3-trifluoromethylphenyl)amino}-1-6-diethylaminofluoran, 2-{3,6-bis(diethylamino)}-9-(o-chloroanilino)xithanthyl benzoic acid lactam, 3-diethylamino-6-methyl-7-(m-trichloromethylanilino)fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl) phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-1-methylphenyl) phthalide, 3-(2'-methoxy-4'-dimethylaminophenyl)-3-(2'-hydroxy-4'-chloro-5'-methylphenyl)phthalide, 3-morpholino-7-(N-propylfluoromethylanilino)fluoran, 3-pyrrolidino-7-trifluoromethylanilinofluoran, 3-diethylamino-5-chloro-7-(N-benzyltrifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-pipelidinofluoran, 2-chloro-3-(N-methyltoluidino)-7-(p-n-butylanilino) fluoran, 3-(N-methyl-N-isopropylamino)-6-methyl-7-anilinofluoran, 3-dibutylamino-6-methyl-7-anilinofluoran, 3-diethylamino-6-ethyl-7-(3-methylanilino)fluoran, 3'6-bis(dimethylamino) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-(p-dimethylaminophenyl)-3-{1,1-bis(p-dimethylaminophenyl)ethylene-2-il}phthalide, 3-(p-dimethylaminophenyl)-3-{1,1-bis(p-dimethylaminophenyl) ethylene-2-il}-6-dimethylaminophthalide, 3-(p-dimethylaminophenyl)-3-(1-p-dimethylaminophenyl-1-phenylethylene-2-il)phthalide, 3-(p-dimethylaminophenyl)-3-(1-p-dimethylaminophenyl-1-p-chlorophenylethylene-2-il)-6-dimethylaminophthalide, 3-(4'-dimethylamino-2'-methoxy)-3-(1"-p-dimethylaminophenyl-1"-p-chlorophenyl-1", 3"-butadiene-4"-il)benzophthalide, 3-(4'-dimethylamino-2'-benzyloxy)-3-(1"-p-dimethylaminophenyl-1"-phenyl-1",3"-butadiene) il}benzophthalide, 3-dimethylamino-6-dimethylaminofluorene-9-spiro-3'-(6'-dimethylamino) phthalide, 3,3-bis-12-(p-dimethylaminophenyl)-2-(p-methoxyphenyl)-ethenyl1-4-4,5,6,7-tetrachlorophthalide, 3-bis{1,1-bis(4-pyrrolidinophenyl)ethylene2-il}-5,6-dichloro-4,7-dibromo phthalide, bis-(p-dimethylaminostyryl)-1-naphthalenesulfonylmethane and bis(p-dimethylaminostyryl)-4-p-tolylsulfonylmethane.

In the present invention, a surfactant by 5 weight % to 20 weight % relative to the leuco dye can be contained in the leuco dye. Examples of surfactants can be used an aqueous solution of dioctylsulfosuccinic acid and the like, but not limited to them.

Tools that can be used to disperse the leuco dye for the purpose of the present invention include a ball mill, an attritor, a sand mill and a high-pressure jet mill. A technique using a media is preferable. The leuco dye can be reduced to micro particles as it is crushed by means of a zirconia media having a particle diameter 0.5 mm or less or primarily crushed by means of a zirconia media having a particle diameter of 0.5 mm to 1.0 mm and then dispersed by means of a zirconia media having a particle diameter of 0.5 mm or less. The average size of the leuco dye particles in a leuco dye dispersion is preferably 0.3 μm or less.

The size of the leuco dye particles in a leuco dye dispersion can be gauged by means of any known ordinary technique such as the laser analysis/scattering method (Microtrack HRA9320-X100, Horiba LA920, Lasentec FBRM), the centrifugal sedimentation method, the use of a Coulter counter and the use of an electron microscope. The viscosity of the leuco dye dispersion is preferably 10 cps to 800 cps at 25° C.

Any of various electron accepting substances reacting with a leuco dye to make the latter exerts a coloring effect when heated may be used for the purpose of the present invention.

4-hydroxydimethyl phthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone, 4-hydroxy-4'-(p-chlorobenzyloxy)diphenylsulfone and diphenyl sulfone derivatives expressed by General Formula (1) shown below. Of these, a combination of 4-hydroxy-4'-allyloxydiphenylsulfone and a diphenyl sulfone derivative expressed by General Formula (1) is particularly preferable:

General Formula (1)

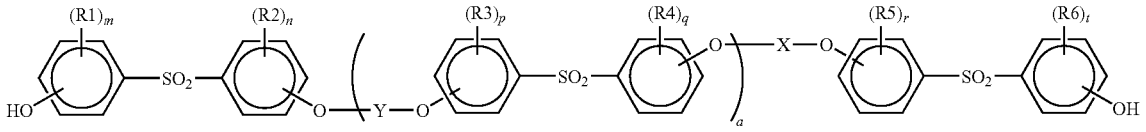

Examples of such substances include phenol type compounds, organic and inorganic acidic compounds and esters and salts thereof as listed below.

Specific examples include gallic acid, salicylic acid, 3-isopropyl salicylate, 3-cyclohexyl salicylate, 3,5-di-tert-butyl salicylate, 3,5-di-α-methylbenzyl salicylate, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, Novolac type phenol resin, 2,2'-thiobis(4,6-dichlorophenol), catechol, resorcin, hydroquinone, pyrogallol, phloroglucine, phloroglucine carboxylic acid, 4-tert-octylcatechol, 2,2'-methylenebis(4-chlorophenol), 2,2'-methylenebis(4-methyl-6-tert-butylphenol), 2,2'-dihydroxydiphenyl, p-hydroxyethyl benzoate, p-hydroxypropyl benzoate, p-hydroxybutyl benzoate, p-hydroxybenzyl benzoate, p-hydroxy-p-chlorobenzyl benzoate, p-hydroxy-o-chlorobenzyl benzoate, p-hydroxy-p-methylbenzyl benzoate, p-hydroxy-n-ocyl benzoate, benzoic acid, zinc salicylate, 1-hydroxy-2-naphthoic acid, 2-hydroxy-6-zinc naphthoate, 4-hydroxydiphenylsulfone, 4-hydroxy-4'-chlorodiphenylsulfone, bis-(4-hydroxyphenyl)sulfide, 2-hydroxy-p-toluic acid, 3,5-di-tert-butyl-zinc salicylate, 3,5-di-tert-butyl-tin salicylate, tartaric acid, oxalic acid, maleic acid, citric acid, succinic acid, stearic acid, 4-hydroxyphthalic acid, boric acid, thiourea derivatives, 4-hydroxythiophenol derivatives, bis-(4-hydroxyphenyl)acetic acid, bis-(4-hydroxyphenyl)ethyl acetate, bis-(4-hydroxyphenyl)-n-propyl acetate, bis-(4-hydroxyphenyl)-n-butyl acetate, bis-(4-hydroxyphenyl)phenyl acetate, bis-(4-hydroxyphenyl)benzyl acetate, bis-(4-hydroxyphenyl)phenethyl acetate, bis-(3-methyl-4-hydroxyphenyl)acetic acid, bis-(3-methyl-4-hydroxyphenyl)methyl acetate, bis-(3-methyl-4-hydroxyphenyl)-n-propyl acetate, 1,7-bis(4-hydroxyphenylthio)3,5-dioxaheptane, 1,5-bis(4-hydroxyphenylthio)-3-oxapentane, In General Formula (1), X and Y may be the same to each other or different from each other, may be in the form of a straight chain or a branched chain, and each represents a hydrocarbon group having 1 to 12 carbon atoms that may have a saturated or an unsaturated ether bond, or a group expressed by any one of the following Formula (2) and Formula (3); "a" represents an integer of 0 to 10; each of R1 through R6 independently represents any one of a halogen atom, an alkyl group having 1 to 6 carbon atoms and an alkenyl group having 1 to 6 carbon atoms; and "m", "n", "p", "q" "r" and "t" each represents an integer of 0 to 4, when the integer is 2 or more, corresponding two or more of R1 through R6 may be different from each other, General Formula (2)

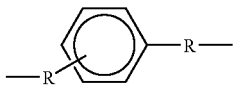

General Formula (3)

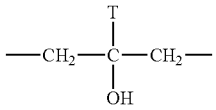

In General Formulas (2) and (3), R represents any one of a methylene group and an ethylene group, and T represents any one of a hydrogen atom and an alkyl group having 1 to 4 carbon atoms.

As compound expressed by the above General Formula (1), developer D-90 (tradename, available from Nippon Soda Co., Ltd.) is a typical example that can preferably be used for the purpose of the present invention. The chemical formula of Developer D-90 in the General Formula (1) is such that p, q, r and t are all equal to 0, in other words, there are no substituents of R3, R4, R5 and R6 and hydrogen atoms are at all the substitutable positions of the benzene ring, while X and Y are divalent groups of diethyl ether having bonding hands at the opposite terminals that are equally expressed by ($—CH_2CH_2OCH_2CH_2—$).

A filler selected from various fillers may be used in the heat-sensitive color-developing layer for the purpose of maintaining the matching properties of the heat-sensitive recording material when it is used for printing.

Examples of fillers include fine powders of inorganic substances such as calcium carbonate, silica, zinc oxide, titanium oxide, aluminum hydroxide, zinc hydroxide, barium sulfate, clay kaolin, talc and calcium and silica that are surface-treated as well as fine powders of organic substances such as urea-formalin resin, styrene/methacrylic acid copolymer, polystyrene resin and vinylidene chloride resin.

Of these, the use of calcium carbonate is preferable because it can improve the whiteness degree in ground color and the fog on the texture is reduced in a heat-resisting environment.

Any of various thermally fusible substances may be purposely added to the heat-sensitive color-developing layer (e.g., as sensitivity enhancer). However, the addition of such a thermally fusible substance should be refrained or a compound having a melting point 100° C. or more should be selected for the addition when the heat-sensitive recording material is required to be highly heat-resistant because it is to be used for wrapping prepared meals. Specific examples of compounds having a melting point 100° C. or more non-limitatively include fatty acids such as stearic acid and behenic acid, amides of fatty acids such as amide stearate and amide palmitate, metal salts of fatty acids such as zinc stearate, aluminum stearate, calcium stearate, zinc palmitate and zinc behenate, p-benzylbiphenyl, m-terphenyl, p-acetyl biphenyl, triphenyl methane, p-benzyloxybenzyl benzoate, β-benzyloxynaphthalene, β-phenyl naphthoate, 1-hydroxy-2-phenyl naphthoate, 1-hydroxy-2-methyl naphthoate, diphenyl carbonate, glarecoal carbonate, dibenzyl terephthalate, dimethyl terephthalate, 1,4-dimethoxynaphthalene, 1,4-diethoxynaphthalene, 1,4-dibenzyloxynaphthalane, 1,2-diphenoxyethane, 1,2-bis(3-methylphenoxy)ethane, 1,2-bis(4-methylphenoxy)ethane, 1,4-diphenoxy-2-butene, 1,2-bis(methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzyldisulfide, 1,1-diphenylethanol, 1,1-diphenylpropanol, p-benzyloxybenzylalcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, 1,2-bis(3,4-dimethylphenyl)ethane, dibenzyl oxalate, bis(4-methylbenzyl)oxalate and bis(4-chlorobenzyl)oxalate.

Any of various conventional binding agents may appropriately be used to bind the leuco dye, the developer and the additives on the support when manufacturing a heat-sensitive recording material according to the present invention. Specific examples of binding agents include polyvinyl alcohol, starch and its derivatives, cellulose derivatives such as hydroxymethylcellulose, hydroxyethylcellulose, carboxymethylcellulose, methylcellulose and ethylcellulose water-soluble polymers such as sodium polyacrylate, polyvinylpyrrolidone, acrylamide/acrylate copolymer, acrylamide/acrylate/methacrylic acid ternary copolymer, alkali salt of styrene/maleic acid anhydride copolymer, alkali salt of isobutylene/maleic acid anhydride copolymer, polyacrylamide, sodium alginate, gelatin and casein as well as emulsions of vinylpolyacetate, polyurethane, polyacrylic acid, polyacrylates, vinylchloride/vinylacetate copolymer, polybutylmethacrylate and ethylene/vinylacetate copolymer and latexes such as styrene/butadiene copolymer, styrene/butadiene/acryl based copolymers.

—Protective Layer—

The protective layer contains a binder resin and a filler along with, if necessary other components.

Examples of binder resins include water-soluble resins such as polyvinyl alcohol, cellulose derivatives, starch and its derivatives, carboxylic acid-modified polyvinyl alcohol, polyacrylic acid and its derivatives, styrene-acrylic acid copolymer and its derivatives, poly(meth)acrylamide and its derivatives, styrene-acrylic acid-acrylamide copolymer, amino-group-modified polyvinyl alcohol, epoxy-modified polyvinyl alcohol, polyethyleneimine, aqueous polyester, aqueous polyurethane, isobutylene-maleic acid anhydride copolymer and its derivatives, polyester, polyurethane, acrylate ester based (co)polymers, styrene-acryl based copolymers, epoxy resins, polyvinyl acetate, polyvinylidene chloride, polyvinyl chloride and their derivatives. Of these, diacetone modified polyvinyl alcohol and water-soluble acetoacetyl modified polyvinyl alcohol resin are particularly preferable.

Particularly, the reaction of the dye in the protective layer material and the heat-sensitive color-developing layer with the developer is suppressed to further improve the texture whiteness degree when diacetone modified polyvinyl alcohol is used as binder resin and a hydrazide compound is employed to make the resin water-resistant.

The hydrazide compound is not particularly limited as long as it has a hydrazide group. Examples thereof include hydrazine, carbohydrazide, dihydrazide oxalate, hydrazide formate, hydrazide acetate, dihydrazide malonate, dihydrazide succinate, dihydrazide adipate, hydrazide azelate, dihydrazide sebacate, dihydrazide dodecanedioate, dihydrazide maleate, dihydrazide fumarate, dihydrazide itaconate, hydrazide benzoate, dihydrazide glutarate, hydrazide diglycolate, dihydrazide tartrate, dihydrazide malate, hydrazide isophthalate, dihydrazide terephthalate, 2,7-dihydrazide naphthoate and hydrazide polyacrylate. Any of the above listed hydrazides may be used alone or two or more of them may be used in combination. Of these hydrazides, dihydrazide adipate is particularly preferable from the viewpoint of water-resistance and safety.

While the ratio to which the hydrazide compound is added varies depending on the extent of modification of the functional group of the hydrazide compound and the type of the compound, it is preferably between 0.1 part by weight and 20 parts by weight, more preferably between 1 part by weight and 10 parts by weight relative to 100 parts by weight of the binder resin.

While the filler to be used for the protective layer may be selected from the fillers that can be used for the heat-sensitive color-developing layer, the use of aluminum hydroxide or silica is particularly useful. The ratio to which the filler is added is preferably between 30 wt % and 80 wt %, more preferably between 40 wt % and 70 wt % relative to the entire pattern layer.

The protective layer is applied at a rate of 3.0 $g/m^2$ or less. The transfer of heat to the underlying heat-sensitive color-developing layer can be obstructed when the rate of application exceeds the above-cited value.

—Intermediate Layer—

An intermediate layer may be arranged between the support and the heat-sensitive color-developing layer. The intermediate layer contains binder resin, a filler material and, if necessary, one or more than one other components. While the binder resin and the filler may be selected from those described above for the heat-sensitive color-developing layer and the protective layer, the use of a filler having a hollow structure such as an organic filler of hollow particles is preferable because such a filler improves the thermal insulation and the tight contact with the head of the heat-sensitive recording material to consequently enhance the coloring sensitivity of the latter.

The use of micro hollow particles that have a shell of thermal plastic resin and contain air or some other gas in the inside so as to be already in a bubbling condition is particularly preferable. The average particle diameter (outer dimension) of such micro hollow particles is preferably about 3 μm. Hollow particles having a diameter smaller than 0.4 μm are accompanied by production-related problems such as that it is difficult to achieve a desired void ratio for such particles, whereas hollow particles having a diameter greater than 10 μm may produce starchy streaks on the underlying layer to reduce the surface smoothness after the application and drying processes and hence the tight contact with a thermal head so as to degrade the effect of improving the sensitivity. Thus, preferably, the average particle diameter is within a range between 0.4 μm and 10 μm and shows a uniform distribution pattern with little variances.

The void ratio of the micro hollow particles is preferably 80% or greater, more preferably between 90% and 98%. The void ratio is the ratio of the outer diameter to the inner diameter (the size of the hollow part) of each particle and expressed by the formula shown below.

void ratio=(inner diameter of hollow particle/outer diameter of hollow particle)×100

While the thermoplastic resin that forms the shells of the micro hollow particles may be selected from polystyrene polyvinyl chloride, polyvinylidene chloride, polyvinyl acetate, polyacrylate, polyacrylonitrile, polybutadiene and copolymers of any of them, copolymer resin mainly made of vinylidene chloride and acrylonitrile is preferable from the viewpoint of achieving the desired void ratio.

The chemical bonding force between the intermediate layer and the carboxylic-acid-modified polyvinyl alcohol is improved to increase the interlayer adhesion and hence the surface strength of the heat-sensitive recording material when the intermediate layer is made to contain carboxylic-acid-modified polyvinyl alcohol same as the one used as a dispersing agent for the leuco dye in the heat-sensitive color-developing layer. When such a substance is used for the intermediate layer, the ratio to which the carboxylic-acid-modified polyvinyl alcohol is added is preferably 0.1 parts by weight to 0.5 parts by weight relative to 1.0 part by weight of hollow particles from the viewpoint of balancing the coloring properties and the interlayer bonding force that constitute an antinomy.

As the support, a support made of high-quality paper or waste paper pulp (containing 50%), synthetic paper and laminated paper can be used.

Any known technique may be used to form a heat-sensitive color-developing layer, a protective layer and an intermediate layer sequentially on a support. The liquid for the heat-sensitive color-developing layer, the liquid for the protective layer and the liquid for the intermediate layer may be sequentially applied to and dried on the support.

The technique for applying those liquids may be selected from the known coating methods including blade coating method, air knife coating method, gravure coating method, roll coating method, spray coating method, dipping coating method, bar coating method and extrusion coating method.

For the purpose of the present invention, if necessary, a lubricant and a pressure coloring inhibitor conventionally used for heat-sensitive recording materials may be employed as auxiliary additives in addition to the surfactant, the filler and the thermally fusible substance.

Lubricants that can be used for the purpose of the present invention include higher fatty acids and metal salts thereof, amides and esters of higher fatty acids and various animal waxes, plant waxes and mineral waxes including petroleum waxes.

A heat-sensitive recording material according to the present invention can be used for pressure-sensitive type heat-sensitive recording labels. Such labels are prepared by sequentially laying an adhesive layer and a peeling paper base on the rear surface of a sheet. A heat-sensitive recording material according to the present invention can also be used for heat-activation type heat-sensitive recording labels having a heat-activation type adhesive layer on the rear surface thereof. Such a label does not require a peeling paper base and, while its heat-activation type adhesive layer is not adhesive at room temperature between 10° C. and 30° C., the layer exerts adhesive force when heated. A heat-sensitive recording material according to the present invention can also be used as heat-sensitive recording type magnetic material when a magnetic recording layer is arranged on the rear surface.

Tools that can be used for recording on a heat-sensitive recording material according to the present invention include thermal pens, thermal heads and lasers.

Thus, according to the present invention, there is provided a heat-sensitive recording material showing a high texture whiteness degree by using a leuco dye dispersion whose viscosity does not rise remarkably and whose stability does not fall with time if the average particle diameter is reduced to 0.3 μm or less in the dispersion process.

EXAMPLES

Now, the present invention will be further described with reference to Examples and Comparative Examples, however, the present invention is by no means limited by them. In the following description, "part" or "parts" and "%" are "parts by weight" and "weight %" unless specifically noted otherwise. PVA is used for polyvinyl alcohol in the tables and the like shown below whenever appropriate.

(1) Preparation of Components of Heat-Sensitive Color-Developing Layer

[liquid A], [liquid B], [liquid C], [liquid D] and [liquid E] having the respective compositions shown below were prepared by dispersing the following respective compositions by means of a sand grinder.

[Liquid A] Leuco Dye Dispersion

- 3-N-cyclohexyl-N-methylamino-6-methyl-7-anilinofluoran: 20 parts
- 10% aqueous solution of carboxylic-acid-modified polyvinyl alcohol having the weight average degree of polymerization and the modification degree listed in Tables 2-1 and 2-2: 20 parts
- water: 60 parts The leuco dye dispersion was prepared so as to have an average particle diameter of 0.3 μm or less.

[Liquid B] Developer Dispersion (i)

- 4-hydroxy-4'-isopropoxydiphenylsulfone: 20 parts
- 10% aqueous solution of polyvinyl alcohol (Kuraray K polymer KL-318: tradename, available from Kuraray Co, Ltd.): 20 parts
- water: 60 parts

[Liquid C] Developer Dispersion (ii)

4-hydroxy-4'-allyloxydiphenylsulfone: 10 parts developer (D-90: tradename, available from Nippon Soda Co., Ltd.: 10 parts 10% aqueous solution of polyvinyl alcohol (Kuraray K polymer KL-318: tradename, available from Kuraray Co, Ltd.): 20 parts water: 60 parts

[Liquid D]

amorphous silica (MIZUKASIL P-527: tradename, available from Mizusawa Industrial Chemicals Ltd.): 20 parts 10% aqueous solution of polyvinyl alcohol (Kuraray K polymer KL-318: tradename, available from Kuraray Co, Ltd.): 20 parts water: 60 parts

[Liquid E]

calcium carbonate (CALSHITEC BRILLIANT-15: tradename, available from Shiraishi Kogyo Kaisha Ltd.): 20 parts 10% aqueous solution of polyvinyl alcohol (Kuraray K polymer KL-318: tradename, available from Kuraray Co, Ltd.): 20 parts water: 60 parts (2) Preparation of Heat-Sensitive Color-Developing Layer Coating Solution

[liquid A] through [liquid E] as prepared above were mixed to the ratios listed in Tables 1-1 and 1-2 to prepare heat-sensitive color-developing layer coating solutions of Examples 1 through 15 and Comparative Examples 1 through 5.

(3) Preparation of Intermediate Layer Coating Solution

An intermediate layer coating solution was prepared by mixing and dispersing the following composition. Note that hollow resin particles having an average particle diameter of 0.4 μm and a void ratio of 55% were used in Example 7, whereas hollow resin particles having an average particle diameter of 3 μm and a void ratio of 90% were used in Examples 8 through 13. The carboxylic acid-modified PVA used for the intermediate layer coating solution in Tables 1-1 and 1-2 was the same as the one used as a dispersing agent in Example 1 and the respective additive amounts thereof are relative to 1.0 part of the hollow resin particles.

hollow resin particles: 25 parts styrene/butadiene copolymer latex (solid concentration 47.5%, SMARTEX PA-9159: tradename, available from Nippon A&L INC.): 15 parts water: 60 parts (4) Preparation of Protective Layer Coating Solution

[liquid F] having the composition shown below was prepared by dispersion for 24 hours, using a sand mill.

[Liquid F]

aluminum hydroxide (average particle diameter: 0.6 μm, HIGILITE H-43M: tradename, available from Showa Denko K.K.): 20 parts polyvinyl alcohol (GOHSERAN L-3266: tradename, available from Nippon Synthetic Chemical Industry Co., Ltd.): 20 parts water: 60 parts Subsequently, a protective layer coating solution was prepared by stirring and mixing the following composition. In Tables 1-1 and 1-2, the completely saponified PVA of the water-soluble resin (solid content: 10%) is KURARAY POVAL PVA-11 (tradename, available from Kuraray Co, Ltd.) and the diacetone-modified PVA (solid content: 10%) is D-700VH (tradename, available from Japan Vam & Poval Co., Ltd.), while the polyamide epichlorohydrin resin (solid content: 25%) of the water-resistance enhancer is the paper strength agent WS-525 (tradename, available from Seiko PMC Corporation).

[Liquid F]: 75 Parts water soluble resin in Tables 1-1 and 1-2: 100 parts water-resistance enhancer in Tables 1-1 and 1-2: 15 parts 45% room temperature setting type silicon rubber (SE-1980CLEAR: tradename, available from Dow Corning Toray Silicon Co., Ltd.): 0.05 parts water: 90 parts (5) Preparation of Heat-Sensitive Recording Material (Paper)

The above-described heat-sensitive color-developing layer coating solution was applied over a surface of a sheet of paper having a basis weight of 60 g/m$^2$ and dried so that the adhesion amount of the dye was 0.50 g/m$^2$ to form a heat-sensitive color-developing layer. Subsequently, the above-described protective layer coating solution was applied over the surface of the heat-sensitive color-developing layer so that the amount of dry coating was 3.0 g/m$^2$. The paper was then subjected to a super calendar treatment to thereby obtain a heat-sensitive recording material, which was used in Examples 1 through 6 and Comparative Examples 1 through 5.

Similarly, the above-described intermediate layer coating solution was applied over a surface of a sheet of paper having a basis weight of 60 g/m$^2$ and dried so that the amount of dry coating was 3.0 g/m$^2$ to form an intermediate layer, and then the above-described heat-sensitive color-developing layer coating solution was applied over the surface of the intermediate layer so that the adhesion amount of the dye was 0.50 g/m$^2$ and dried to form a heat-sensitive color-developing layer. Subsequently, the above-described protective layer coating solution was applied over the surface of the heat-sensitive color-developing layer so that the amount of dry coating was 3.0 g/m$^2$. The paper was then subjected to a super calendar treatment to thereby obtain a heat-sensitive recording material, which was used in Examples 7 through 15.

TABLE 1-1

| | Intermediate layer coating solution | | | | Heat-sensitive color-developing liquid | | | | | Protective layer coating solution | |
|---|---|---|---|---|---|---|---|---|---|---|---|
| | | Note[1] additive | | | | | | | | | |
| | Intermediate layer Formed/ Not formed | amount of polyvinyl alcohol in claim 1 (parts by wt) | hollow resin particles | void ratio (%) | liquid A | liquid B | liquid C | liquid D | liquid E | water-soluble resin | water-resistance enhancer |
| | | | | | Additive amount (part) | | | | | | |
| Ex. 1 | Not formed | — | — | — | 10 | 25 | — | 15 | — | completely saponified PVA (10%) | polyamide epichlorohydrin resin (25%) |
| Ex. 2 | Not formed | — | — | — | 10 | 25 | — | 15 | — | Same as in Ex. 1 | Same as in Ex. 1 |
| Ex. 3 | Not formed | — | — | — | 10 | 25 | — | 15 | — | Same as in Ex. 1 | Same as in Ex. 1 |

TABLE 1-1-continued

| | Intermediate layer coating solution | | | | Heat-sensitive color-developing liquid | | | | | Protective layer coating solution | |
|---|---|---|---|---|---|---|---|---|---|---|---|
| | Note[1] additive | | | | | | | | | | |
| | Intermediate layer Formed/ Not formed | amount of polyvinyl alcohol in claim 1 (parts by wt) | hollow resin particles | void ratio (%) | liquid A | liquid B | liquid C | liquid D | liquid E | water-soluble resin | water-resistance enhancer |
| | | | | | Additive amount (part) | | | | | | |
| Ex. 4 | Not formed | — | — | — | 10 | 25 | — | 15 | — | Same as in Ex. 1 | Same as in Ex. 1 |
| Ex. 5 | Not formed | — | — | — | 10 | 25 | — | 15 | — | Same as in Ex. 1 | Same as in Ex. 1 |
| Ex. 6 | Not formed | — | — | — | 10 | 25 | — | 15 | — | Same as in Ex. 1 | Same as in Ex. 1 |
| Ex. 7 | Not formed | — | — | — | 10 | 25 | — | — | 15 | Same as in Ex. 1 | Same as in Ex. 1 |
| Ex. 8 | Not formed | — | — | — | 10 | — | 25 | — | 15 | Same as in Ex. 1 | Same as in Ex. 1 |
| Ex. 9 | Not formed | — | — | — | 10 | — | 25 | — | 15 | diacetone-modified PVA (10%) | adipic acid hydrazide |
| Ex. 10 | Formed | 0 | hollow resin particles with average particle diameter 0.4 μm | 55% | 10 | — | 25 | — | 15 | Same as in Ex. 9 | Same as in Ex. 9 |
| Ex. 11 | Formed | 0 | hollow resin particles with average particle diameter 3 μm | 90% | 10 | — | 25 | — | 15 | Same as in Ex. 9 | Same as in Ex. 9 |
| Ex. 12 | Formed | 0.07 | Same as in Ex. 11 | 90% | 10 | — | 25 | — | 15 | Same as in Ex. 9 | Same as in Ex. 9 |
| Ex. 13 | Formed | 0.6 | Same as in Ex. 11 | 90% | 10 | — | 25 | — | 15 | Same as in Ex. 9 | Same as in Ex. 9 |
| Ex. 14 | Formed | 0.1 | Same as in Ex. 11 | 90% | 10 | — | 25 | — | 15 | Same as in Ex. 9 | Same as in Ex. 9 |
| Ex. 15 | Formed | 0.5 | Same as in Ex. 11 | 90% | 10 | — | 25 | — | 15 | Same as in Ex. 9 | Same as in Ex. 9 |

TABLE 1-2

| | Intermediate layer coating solution | | | | Heat-sensitive color-developing liquid | | | | | Protective layer coating solution | |
|---|---|---|---|---|---|---|---|---|---|---|---|
| | Note[1] additive | | | | | | | | | | |
| | intermediate layer Formed/ Not formed | amount of polyvinyl alcohol in claim 1 (parts by wt) | Presence of hollow resin particles | void ratio (%) | liquid A | liquid B | liquid C | liquid D | liquid E | water-soluble resin | water-resistance enhancer |
| | | | | | Additive amount (part) | | | | | | |
| Comp. Ex. 1 | Not formed | — | — | — | 10 | 25 | — | 15 | — | completely saponified PVA (10%) | polyamide epichlorohydrin resin (25%) |
| Comp. Ex. 2 | Not formed | — | — | — | 10 | 25 | — | 15 | — | Same as in Comp. Ex. 1 | Same as in Comp. Ex. 1 |
| Comp. Ex. 3 | Not formed | — | — | — | 10 | 25 | — | 15 | — | Same as in Comp. Ex. 1 | Same as in Comp. Ex. 1 |
| Comp. Ex. 4 | Not formed | — | — | — | 10 | 25 | — | 15 | — | Same as in Comp. Ex. 1 | Same as in Comp. Ex. 1 |
| Comp. Ex. 5 | Not formed | — | — | — | 10 | 25 | — | 15 | — | Same as in Comp. Ex. 1 | Same as in Comp. Ex. 1 |

Note[1]:

Polyvinyl alcohol showing a degree of polymerization of 100% and a modification degree by carboxylic acid of 0.2 was used. The shown parts by weight were relative to 1.0 part by weight of the hollow filler.

TABLE 2-1

| | polyvinyl alcohol added to dye dispersion | | additive amount of | | | | |
|---|---|---|---|---|---|---|---|
| | degree of polymerization | modification degree by carboxylic acid (%) | polyvinyl alcohol relative to 1.0 part by wt of dye (Not dry weight ratio) | filler in heat-sensitive color-developing layer | developer | intermediate layer | protective layer |
| Example 1 | 100 | 0.2 | 0.05 | silica | 4-hydroxy-4'-isopropoxy diphenylsulfone | Not formed | completely saponified PVA + polyamide-epichlorohydrin |
| Example 2 | 400 | 0.2 | 0.05 | silica | Same as in Ex. 1 | Not formed | Same as in Ex. 1 |
| Example 3 | 400 | 1.0 | 0.05 | silica | Same as in Ex. 1 | Not formed | Same as in Ex. 1 |
| Example 4 | 400 | 1.0 | 0.5 | silica | Same as in Ex. 1 | Not formed | Same as in Ex. 1 |
| Example 5 | 400 | 1.0 | 0.1 | silica | Same as in Ex. 1 | Not formed | Same as in Ex. 1 |
| Example 6 | 400 | 1.0 | 0.4 | silica | Same as in Ex. 1 | Not formed | Same as in Ex. 1 |
| Example 7 | 400 | 1.0 | 0.4 | calcium carbonate | Same as in Ex. 1 | Not formed | Same as in Ex. 1 |
| Example 8 | 400 | 1.0 | 0.4 | calcium carbonate | 4-hydroxy4'-allyloxydiphenyl-sulfone + D90 | Not formed | Same as in Ex. 1 |
| Example 9 | 400 | 1.0 | 0.4 | calcium carbonate | Same as in Ex. 8 | Not formed | diacetone-modified PVA + hydrazide compound |
| Example 10 | 400 | 1.0 | 0.4 | calcium carbonate | Same as in Ex. 8 | containing hollow filler (void ratio 55%) | Same as in Ex. 9 |
| Example 11 | 400 | 1.0 | 0.4 | calcium carbonate | Same as in Ex. 8 | containing hollow filler (void ratio 90%) | Same as in Ex. 9 |
| Example 12 | 400 | 1.0 | 0.4 | calcium carbonate | Same as in Ex. 8 | Same as in Ex. 11 | Same as in Ex. 9 |
| Example 13 | 400 | 1.0 | 0.4 | calcium carbonate | Same as in Ex. 8 | Same as in Ex. 11 | Same as in Ex. 9 |
| Example 14 | 400 | 1.0 | 0.4 | calcium carbonate | Same as in Ex. 8 | Same as in Ex. 11 | Same as in Ex. 9 |
| Example 15 | 400 | 1.0 | 0.4 | calcium carbonate | Same as in Ex. 8 | Same as in Ex. 11 | Same as in Ex. 9 |

TABLE 2-2

| | polyvinyl alcohol added to dye dispersion | | additive amount of | | | | |
|---|---|---|---|---|---|---|---|
| | degree of polymerization | modification degree by carboxylic acid (%) | polyvinyl alcohol relative to 1.0 part by wt of dye (Not dry weight ratio) | filler in heat-sensitive color-developing layer | developer | intermediate layer | protective layer |
| Comp. Ex. 1 | 50 | 1.0 | 0.1 | silica | 4-hydroxy-4'-isopropoxy diphenylsulfone | Not formed | completely saponified PVA + polyamide-epichlorohydrin |
| Comp. Ex. 2 | 600 | 1.0 | 0.1 | silica | Same as in Comp. Ex. 1 | Not formed | Same as in Comp. Ex. 1 |
| Comp. Ex. 3 | 1600 | 1.0 | 0.1 | silica | Same as in Comp. Ex. 1 | Not formed | Same as in Comp. Ex. 1 |
| Comp. Ex. 4 | 400 | 0.1 | 0.1 | silica | Same as in Comp. Ex. 1 | Not formed | Same as in Comp. Ex. 1 |
| Comp. Ex. 5 | 400 | 3.0 | 0.1 | silica | Same as in Comp. Ex. 1. | Not formed | Same as in Comp. Ex. 1 |

(6) Evaluation test

The following tests were conducted on the prepared heat-sensitive recording materials. Tables 3-1 and 3-2 show the obtained results.

<Viscosity of Dye Dispersion>

Each of the dye dispersions was observed at 20° C. by means of E type viscometer available from Tokyo Keiki Kogyo Co., Ltd.

<Stability of Dye Dispersion>

The average particle diameter of each of the dye dispersions was measured by means of a particle size distribution analyzer (LA920: tradename, available from Horiba Ltd.).

Each of the dispersions was stored under the temperature condition of 30° C. for 48 hours immediately after the dispersion and the change in the average particle diameter was measured with reference to the average particle diameter immediately after the dispersion. The following rating system was used.

A: A change in average particle diameter was less than 10%

B: A change in average particle diameter was 10% or more and less than 20%

C: A change in average particle diameter was 20% or more and less than 30%

D: A change in average particle diameter was 30% or more

<Background Reflectance Test>

The background reflectance was determined for each sample by means of a reflectometer (Model 577: tradename, available from Photovolt Instruments Inc.) in order to quantify the difference of whiteness degree attributable to liquid fog (using a green filter).

<Color Developing Property Test>

Color developing properties were printed by means of a printing simulator for heat-sensitive recording materials available from Ohkura Engineering Co., Ltd., by applying energy at 0.27 mj/dot, 0.36 mj/dot and 0.45 mj/dot, respectively, and the coloring density was observed for each obtained sample by means of a McBeth densitometer RD-914.

<Interlayer Bonding Force>

A piece of adhesive tape available from Nichiban Co., Ltd. was applied to the colored surface of each of the heat-sensitive recording materials and the force required to peel off the surface layer was measured by pulling the tape at a rate of 70 m/min by means of an OMNIACE RT3300 available from Tester Sangyo Co., Ltd.

TABLE 3-1

| | Viscosity of dye dispersion (cps) | Dye dispersion stability | Background reflectance (%) | Color developing property 0.27 mj/dot | 0.36 mj/dot | 0.45 mj/dot | Interlayer bonding force mN/18 mm |
|---|---|---|---|---|---|---|---|
| Example 1 | 200 | B | 91 | 0.45 | 1.02 | 1.30 | 4.3 |
| Example 2 | 320 | B | 91 | 0.43 | 1.05 | 1.31 | 4.6 |
| Example 3 | 330 | B | 90 | 0.47 | 1.05 | 1.32 | 4.2 |
| Example 4 | 380 | B | 91 | 0.46 | 1.04 | 1.31 | 4.4 |
| Example 5 | 250 | A | 91 | 0.47 | 1.06 | 1.33 | 4.3 |
| Example 6 | 300 | A | 91 | 0.48 | 1.05 | 1.34 | 4.5 |
| Example 7 | 300 | A | 93 | 0.54 | 1.06 | 1.33 | 5.1 |
| Example 8 | 300 | A | 95 | 0.56 | 1.10 | 1.38 | 4.8 |
| Example 9 | 300 | A | 97 | 0.55 | 1.12 | 1.37 | 4.6 |
| Example 10 | 300 | A | 97 | 0.85 | 1.27 | 1.43 | 4.6 |
| Example 11 | 300 | A | 97 | 1.03 | 1.33 | 1.44 | 5.3 |
| Example 12 | 300 | A | 97 | 1.04 | 1.35 | 1.42 | 5.8 |
| Example 13 | 300 | A | 97 | 0.98 | 1.29 | 1.42 | 7.6 |
| Example 14 | 300 | A | 97 | 1.05 | 1.34 | 1.43 | 7.3 |
| Example 15 | 300 | A | 97 | 1.06 | 1.33 | 1.45 | 7.2 |

TABLE 3-2

| | Viscosity of dye dispersion (cps) | Dye dispersion stability | Background reflectance (%) | Color developing property 0.27 mj/dot | 0.36 mj/dot | 0.45 mj/dot | Interlayer bonding force mN/18 mm |
|---|---|---|---|---|---|---|---|
| Comp. Example 1 | 150 | D | 88 | 0.23 | 0.80 | 1.11 | 4.5 |
| Comp. Example 2 | 840 | C | 87 | 0.35 | 0.95 | 1.27 | 4.7 |
| Comp. Example 3 | 1,400 | C | 87 | 0.38 | 0.99 | 1.29 | 4.9 |
| Comp. Example 4 | 370 | C | 88 | 0.82 | 1.29 | 1.39 | 4.2 |
| Comp. Example 5 | 360 | C | 86 | 0.99 | 1.34 | 1.42 | 4.2 |

The results of the tests shown in Tables 3-1 and 3-2 will be explained below.

The results of Examples 1 through 3 demonstrated that when the weight average degree of polymerization of carboxylic acid-modified PVA was in the rage of 100 to 400 and the carboxylic acid-modification degree was in the range of 0.2 mol % to 1.0 mol %, the heat-sensitive recording materials showed an excellent viscosity property and an excellent stability of the dye dispersion and a high background reflectance of 90% or more (=a high whiteness degree). In contrast, the heat-sensitive recording materials of Comparative Example 2 and 3 which had a weight average degree of polymerization of carboxylic acid-modified PVA and a carboxylic acid-modification degree that were out of the above-noted ranges resulted in a poor dispersion stability and a low background reflectance (=a low whiteness degree). In addition, the heat-sensitive recording materials of Comparative Examples 2 and 3 resulted in a high viscosity of the dispersion.

As shown in the heat-sensitive recording materials of Examples 5 and 6, when the additive amount of the PVA relative to 1.0 part by weight of the dye was in the range of 0.1 parts by weight to 0.4 parts by weight to 1.0 part by weight, the stability of the dye dispersion was further improved.

In the heat-sensitive recording material of Example 7, the background reflectance was further improved due to the effect of calcium carbonate. In the heat-sensitive recording material of Example 8, the texture was further improved due to the combination of specific developers (4-hydroxy-4'-allyloxydiphenylsulfone+cross-linked diphenylsulfone type compound: D90).

Further, in the case of the heat-sensitive recording material of Example 9, it was found that the texture was also be improved by using diacetone-modified PVA and a hydrazide compound for the protective layer.

What is claimed is:

1. A heat-sensitive recording material comprising:

a support, a heat-sensitive color-developing layer containing a leuco dye and a developer, and a protective layer, the heat-sensitive color-developing layer and the protective layer being formed on the support, wherein carboxylic-acid-modified polyvinyl alcohol with a weight average degree of polymerization of 100 to 400 and a modification degree of 0.2 mol % to 1.0 mol % is used as a dispersing agent for dispersing the leuco dye.

2. The heat-sensitive recording material according to claim 1, wherein the content of the carboxylic-acid-modified polyvinyl alcohol is 0.1 parts by weight to 0.4 parts by weight relative to 1 part by weight of the leuco dye.

3. The heat-sensitive recording material according to claim 1, wherein the heat-sensitive color-developing layer contains calcium carbonate as a filler.

4. The heat-sensitive recording material according to claim 1, wherein the developer comprises 4-hydroxy-4'allyloxydiphenylsulfone and a diphenyl sulfone derivative expressed by the following General Formula (1):

where X and Y may be the same to each other or different from each other, may be in the form of a straight chain or a branched chain, and each represents a hydrocarbon group having 1 to 12 carbon atoms that may have a saturated or an unsaturated ether bond, or a group expressed by any one of the following Formula (2) and Formula (3); "a" represents an integer of 0 to 10; each of R1 through R6 independently represents any one of a halogen atom, an alkyl group having 1 to 6 carbon atoms and an alkenyl group having 1 to 6 carbon atoms; and "m", "n", "p", "q", "r" and "t" each represents an integer of 0 to 4, when the integer is 2 or more, corresponding two or more of R1 through R6 may be different from each other, General Formula (2)

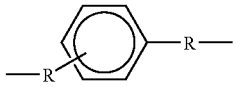

General Formula (3)

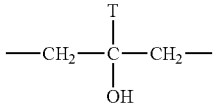

where R represents any one of a methylene group and an ethylene group, and T represents any one of a hydrogen atom and an alkyl group having 1 to 4 carbon atoms.

5. The heat-sensitive recording material according to claim 1, wherein the protective layer contains diacetone-modified polyvinyl alcohol and a hydrazide compound.

6. The heat-sensitive recording material according to claim 1, further comprising an intermediate layer containing at least hollow particles between the support and the heat-sensitive color-developing layer.

7. The heat-sensitive recording material according to claim 6, wherein the hollow particles have a void ratio of 80% or more.

8. The heat-sensitive recording material according to claim 6, wherein the intermediate layer contains carboxylic-acid-modified polyvinyl alcohol with a weight average degree of polymerization of 100 to 400 and a modification degree of 0.2 mol % to 1.0 mol %.

9. The heat-sensitive recording material according to claim 8, wherein the carboxylic-acid-modified polyvinyl alcohol content of the intermediate layer is 0.1 parts by weight to 0.5 parts by weight relative to 1.0 part by weight of the hollow particles.

10. A heat-sensitive recording label comprising:

a heat-sensitive recording material, an adhesive layer, and a peeling paper base, the adhesive layer and the peeling paper base being formed on the rear surface of the heat-sensitive recording material in this order, General Formula (1)

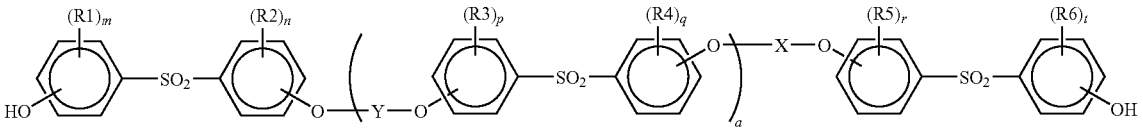

wherein the heat-sensitive recording material comprises a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mol % to 1.0 mol % is used as a dispersing agent for dispersing the leuco dye.

11. A heat-activation type heat-sensitive recording label eliminating the need for a peeling paper base, comprising:

a heat-sensitive recording material, and a heat-activation type adhesive layer formed on the rear surface of the heat-sensitive recording material, wherein the heat-sensitive recording material comprises a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mol % to 1.0 mol % is used as a dispersing agent for dispersing the leuco dye, and the heat-activation type adhesive layer is not adhesive at room temperature but is actively adhesive when heated.

12. A heat-sensitive recording type magnetic material comprising:

a heat-sensitive recording material, and a magnetic recording layer formed on the rear surface of the heat-sensitive recording material, wherein the heat-sensitive recording material comprises a support, a heat-sensitive color-developing layer containing a leuco dye and a developer, and a protective layer, the heat-sensitive color-developing layer and the protective layer being formed on the support, and carboxylic-acid-modified polyvinyl alcohol with a weight average degree of polymerization of 100 to 400 and a modification degree of 0.2 mol % to 1.0 mol % is used as a dispersing agent for dispersing the leuco dye.

* * * * *